US011034119B2

(12) United States Patent
Yeager

(10) Patent No.: US 11,034,119 B2
(45) Date of Patent: Jun. 15, 2021

(54) BOTTOM GUSSET PACKAGE WITH FOLDED GUSSET

(71) Applicant: Innoflex Incorporated, Birmingham, AL (US)

(72) Inventor: James W. Yeager, Mobile, AL (US)

(73) Assignee: Innoflex Incorporated, Birmingham, AL (US)

( * ) Notice: Subject to any disclaimer, the term of this patent is extended or adjusted under 35 U.S.C. 154(b) by 0 days.

(21) Appl. No.: 15/778,335

(22) PCT Filed: Nov. 21, 2016

(86) PCT No.: PCT/US2016/063084

§ 371 (c)(1),
(2) Date: May 23, 2018

(87) PCT Pub. No.: WO2017/091504

PCT Pub. Date: Jun. 1, 2017

(65) Prior Publication Data

US 2018/0339481 A1 Nov. 29, 2018

Related U.S. Application Data

(60) Provisional application No. 62/258,760, filed on Nov. 23, 2015.

(51) Int. Cl.
*B31B 70/26* (2017.01)
*B31B 70/64* (2017.01)
(Continued)

(52) U.S. Cl.
CPC ..... *B31B 70/266* (2017.08); *B31B 70/64* (2017.08); *B31B 70/8123* (2017.08);
(Continued)

(58) Field of Classification Search
CPC ..... B65D 75/008; B65D 75/44; B31B 70/64; B31B 70/266; B31B 70/8123;
(Continued)

(56) References Cited

U.S. PATENT DOCUMENTS 4,266,469 A * 5/1981 Feldkamper ..... B31B 70/00 493/219
6,719,678 B1 * 4/2004 Stern ..... B65D 33/2508 493/212
(Continued)

FOREIGN PATENT DOCUMENTS

DE 102008039953 A1 3/2010
EP 1620321 B1 8/2014
(Continued)

OTHER PUBLICATIONS

Supplemental European Search Report dated May 14, 2019.
Communication pursuant to Article 94(3) EPC dated May 14, 2020.

*Primary Examiner* — Thomas M Wittenschlaeger
(74) *Attorney, Agent, or Firm* — Wood, Phillips, Katz, Clark & Mortimer

(57) ABSTRACT

A bottom-gusseted package comprising a package body, and a bottom gusset positioned transversely of a longitudinal axis of the package body. Formation of the bottom-gusseted package is effected by positioning individual sleeves transversely of the longitudinal axis of a flexible web which forms the package body. During package formation, the flexible web is folded and cut to form individual packages, with each individual sleeve positioned to form a bottom gusset in a respective package. Attendant to folding of the
(Continued)

flexible web, each gusset-forming sleeve is folded. Optionally, the individual sleeve portions can be configured such that when the flexible web is cut to form individual packages, each individual sleeve is cut to form a bottom gusset in one package, and a top sleeve portion in an adjacent package.

9 Claims, 8 Drawing Sheets

(51) Int. Cl.

| | |
|---|---|
| ***B31B 70/81*** | (2017.01) |
| ***B65D 75/00*** | (2006.01) |
| ***B65D 75/44*** | (2006.01) |
| *B31B 160/20* | (2017.01) |
| *B31B 155/00* | (2017.01) |

(52) U.S. Cl.
CPC ..... *B65D 75/008* (2013.01); *B65D 75/44* (2013.01); *B31B 2155/0012* (2017.08); *B31B 2160/20* (2017.08)

(58) Field of Classification Search
CPC ..... B31B 70/81; B31B 70/8133; B31B 70/00; B31B 70/8122; B31B 70/60; B31B 70/642; B31B 2155/0012; B31B 2155/00; B31B 2155/002; B31B 2160/20
See application file for complete search history.

(56) References Cited

U.S. PATENT DOCUMENTS

| | | | | |
|---|---|---|---|---|
| 8,167,487 | B2 * | 5/2012 | Fuller | B65D 33/34 383/5 |
| 8,430,566 | B2 * | 4/2013 | Brauer | B65D 31/10 383/109 |
| 8,834,024 | B2 * | 9/2014 | Umenaka | B65D 75/008 383/104 |
| 2011/0026855 | A1 | 2/2011 | Fuller | |
| 2011/0268372 | A1 | 11/2011 | Brauer et al. | |
| 2014/0161373 | A1 * | 6/2014 | Yeager | B65D 33/2533 383/42 |
| 2014/0294326 | A1 * | 10/2014 | Yeager | B65D 31/10 383/120 |
| 2016/0137374 | A1 * | 5/2016 | Brosch | B65D 75/002 383/104 |
| 2018/0105296 | A1 * | 4/2018 | Yeager | B65B 61/06 |

FOREIGN PATENT DOCUMENTS

| | | | |
|---|---|---|---|
| JP | 2002046197 | A | 2/2002 |
| JP | 2004292028 | A | 10/2004 |
| JP | 2004306338 | A | 11/2004 |
| JP | 2005263300 | A | 9/2005 |
| JP | 2011031946 | A | 2/2011 |
| JP | 2013100140 | A | 5/2013 |
| JP | 2013116611 | A | 6/2013 |
| JP | 2013144574 | A | 7/2013 |
| WO | 2012099197 | A1 | 7/2012 |
| WO | 2014204465 | A1 | 12/2014 |
| WO | 2015042505 | A1 | 3/2015 |
| WO | 2015057478 | A1 | 4/2015 |

* cited by examiner

BOTTOM GUSSET PACKAGE WITH FOLDED GUSSET

TECHNICAL FIELD

The present invention relates generally to packages formed from polymeric film webs, and more particularly to a bottom-gusseted package including a folded bottom gusset positioned transversely of a longitudinal axis of the package, with the configuration of the package, and its method of formation, permitting use with associated form, fill, and seal equipment.

BACKGROUND OF THE INVENTION

Packages formed from plastic, polymeric film material have found widespread application in the market place for convenient and efficient packaging of all manner of food and non-food products. Packages of this nature typically are formed by folding and sealing a web of polymeric material to form a package body having front and rear package panels, with the package panels joined to each other at margins thereof. Depending upon the method of formation, the front and rear package panels may be joined to each other either by folded portions of the package body, or at seals (typically heat seals) joining the package panels to each other.

Non-gusseted packages of this type are sometimes referred to as "pillow packs", and do not include either side gussets or top or bottom gussets. However, for many applications it is desirable to form a gusseted package that is, providing the package with inwardly-extended, pleat-like gussets at one or more margins of the package body. For example, side-gusseted packages include inwardly extending side gussets at opposite lateral sides of the package body, which side gussets join respective lateral edges of the front and rear package panels to each other.

For some applications, it is especially desirable to provide a bottom-gusseted package, that is, a package having an inwardly extending gusset at the bottom of the package body. By virtue of the breadth and stability provided by the bottom gusset, packages of this nature can frequently be configured to be self-standing, promoting efficient display for consumer selection.

Heretofore, bottom-gusseted packages have typically been formed by pleating a web of polymeric material in a direction parallel to the longitudinal axis of the web. Suitable ploughs and forming guides shape and configure the polymeric web as it moves longitudinally, including formation of a continuous, inwardly extending bottom gusset in the web material. Subsequently, suitable seals are formed transversely of the web to define individual package bodies, each including front and rear package panels, with each including a bottom gusset. Individual package bodies are formed by cutting the web of material at the transversely extending seals, with the contents of each package deposited therein either before or after cutting of the web into individual packages.

As will be appreciated by this typical formation technique, the height or vertical dimension of each package body is equal to approximately one-half of the width of the polymeric web, less the dimension of the bottom gusset. As a consequence, the maximum height of any package being formed is essentially limited by the maximum width of the web of polymeric material which the forming equipment is capable of handling.

The present invention contemplates a bottom-gusseted package, and a method of formation, which addresses the shortcomings in the conventional forming of bottom-gusseted package. This is achieved by forming each package with a bottom gusset positioned transversely of the longitudinal axis of the polymeric film web and each package, with the bottom gusset having at least one fold therein. The bottom-gusseted packages of any selected height can be readily and efficiently formed.

SUMMARY OF THE INVENTION

A bottom-gusseted package embodying the principles of the present invention comprises a package body formed from a flexible web having a longitudinal axis. The flexible web is folded to define a front package panel and a rear package of the package body. The front and rear package panels are joined to each other at respective lateral side margins of the package body, with the flexible web being joined to itself along a seam which extends parallel to the longitudinal axis of the flexible web.

A package formed in accordance with the present invention includes a bottom gusset positioned between the front and rear package panels, with the bottom gusset extending upwardly and inwardly from the lower edges of the front and rear package panels. The bottom gusset is positioned within the package body transversely of the longitudinal axis of the package body, and transversely of the longitudinal axis of the flexible web from which the package body is formed. This permits a package body to be very efficiently formed at any selected height.

Efficient formation of the present package is facilitated by arranging the bottom gusset within the package such that each gusset is folded within the package body, along a fold line that extends parallel to the longitudinal axis of the package. In certain illustrated embodiments, this is achieved by folding at least one end of each individual sleeve which forms the bottom gusset of the package. Normal manufacturing tolerances and variations are readily accommodated while ensuring formation of a package in which the contents are sealed, and the bottom gussets opens as intended.

In an alternative embodiment, each gusset is folded to form each package with a pair of bottom gussets, with each package preferably including a pair of inwardly extending side gussets which extend between the pair of bottom gussets.

In accordance with the present invention, a method of making bottom-gusseted packages, comprises the steps of providing a flexible web of material having a longitudinal axis, which web provides the body of each package being formed. Suitable polymeric material can be employed by virtue of its liquid-impermeable characteristics, and heat-sealing capabilities.

The present method further comprises providing a plurality of folded, individual sleeves, with each sleeve eventually forming the bottom gusset of the package. The individual sleeves can be cut from a folded, sleeve-forming web. The individual sleeves are joined to the flexible web in spaced apart relationship longitudinally thereof. The spacing between the individual sleeves corresponds to the length of each of the bottom-gusseted packages being formed.

To permit heal-sealing formation of the present package, the exterior surface of each individual sleeve is readily heat-sealable to the flexible web which forms the package body. In contrast, the inside surface of each sleeve is non-heat sealable to itself, thus facilitating formation of a bottom gusset which spreads or opens to permit the packages being formed to be generally self-standing. Thus, the interior surface of the folded sleeve has heat-sealing characteristics that differ from the heat-sealing characteristics of the exterior surface of the sleeve. To this end, the sleeve-forming web can be made from a material which is different than the flexible web which forms the package body.

Package formation next includes folding the flexible web of material, and joining the lateral margins thereof to form a folded flexible web. The effects formation of a package body for each of the bottom-gusseted packages, including a front package panel and a rear package panel joined at opposite side margins thereof.

Notably, attendant to the folding step, each individual sleeve within the folded web is also folded. As will described, folding of one or both ends of each individual, gusset-forming sleeve permits efficient placement of the individual sleeves on the flexible web, and facilitates heat-sealing the web and sleeve to close the interior of the package being formed.

Attendant to package filling, such as on a form, fill and sealing apparatus, the folded, flexible web is cut at intervals each corresponding in length to the length of each bottom-gusseted package. Each individual sleeve provides a bottom gusset for a respective one of the packages being formed. While the individual sleeves can be joined to the flexible web in conjunction with package filling, it is contemplated that the gusset-forming sleeves can be joined to the flexible web apart from the filling process, with a flexible web having such "pre-applied" gusset-forming sleeves rolled for subsequent use with filling machinery.

Attendant to cutting the folding web into individual packages, the individual sleeves providing each bottom gusset can be substantially simultaneously cut, so that a portion of each individual sleeve provides: (1) the bottom gusset for one of the packages being formed, and (2) a top sleeve portion for an adjacent one of the packages being formed. The top sleeve portion can be configured to include a dispensing feature, an upper package seal, and/or a recloseable fastener feature. However, it is within the purview of the present invention to form packages with a bottom gusset only, without a top sleeve portion.

The folding step can include folding the flexible web of material generally at the longitudinal axis thereof, so that each of the individual sleeves extends generally between said longitudinal axis and the joined lateral margins of said flexible web. By formation in this manner, each of the individual sleeves is folded only at one end thereof.

If desired, each of the individual sleeves can be provided with a length which is greater than the width of the folded web of flexible material, such that the folding step includes folding each end of each of the individual sleeves. However, in some instances, due to normal manufacturing tolerances, only one end of each individual sleeve is folded.

The present method contemplates forming at least one side seal joining the front and rear package panels to the to the individual sleeve, including joining the front and rear package panels to each other above the bottom gusset. A pair of side seals can be formed which join the front and rear package panels to each individual sleeve, wherein the side seals extend above and overlap the respective individual sleeve and join the front and rear package panels to each other.

Another aspect of the present invention contemplates that the step of joining the lateral margins of the flexible web includes forming a fin seal comprising two plies of the flexible web material. The fin seal can be folded against the rear package panel, so a thickness of package at the fin seal is substantially equal to a thickness of each package at the folded ends of the individual sleeve providing the bottom gusset of the package. Heat-sealing formation is desirably facilitated.

In another aspect of the invention, the flexible web of material can be formed to include a pair of inwardly extending side gussets. In this embodiment, the folding step includes folding each of the individual sleeves to extend adjacent to itself within the folded flexible web to thereby form each of the packages with a pair of bottom gussets adjacent to each other. The method includes joining inner edge portions of bottom gussets to each other to close the interior of the package, with the pair of side gussets each extending between the pair of bottom gussets.

As noted, it is presently contemplated that the folded sleeve-forming web from which the bottom gussets are formed has an inside surface of which does not heat-seal to itself. Since package formation, and advancement through the form, fill and seal machine can sometimes orient the bottom gusset in the "leading" direction, in can be desirable to close the individual sleeves against opening during such advancement. This can be achieved by closing each of the individual sleeves prior to joining the individual sleeves to the flexible web of material.

Other features and advantages of the present invention will become readily apparent from the following detailed description, the accompanying drawings, and the appended claims.

DESCRIPTION OF THE PREFERRED EMBODIMENT

Figure 1:
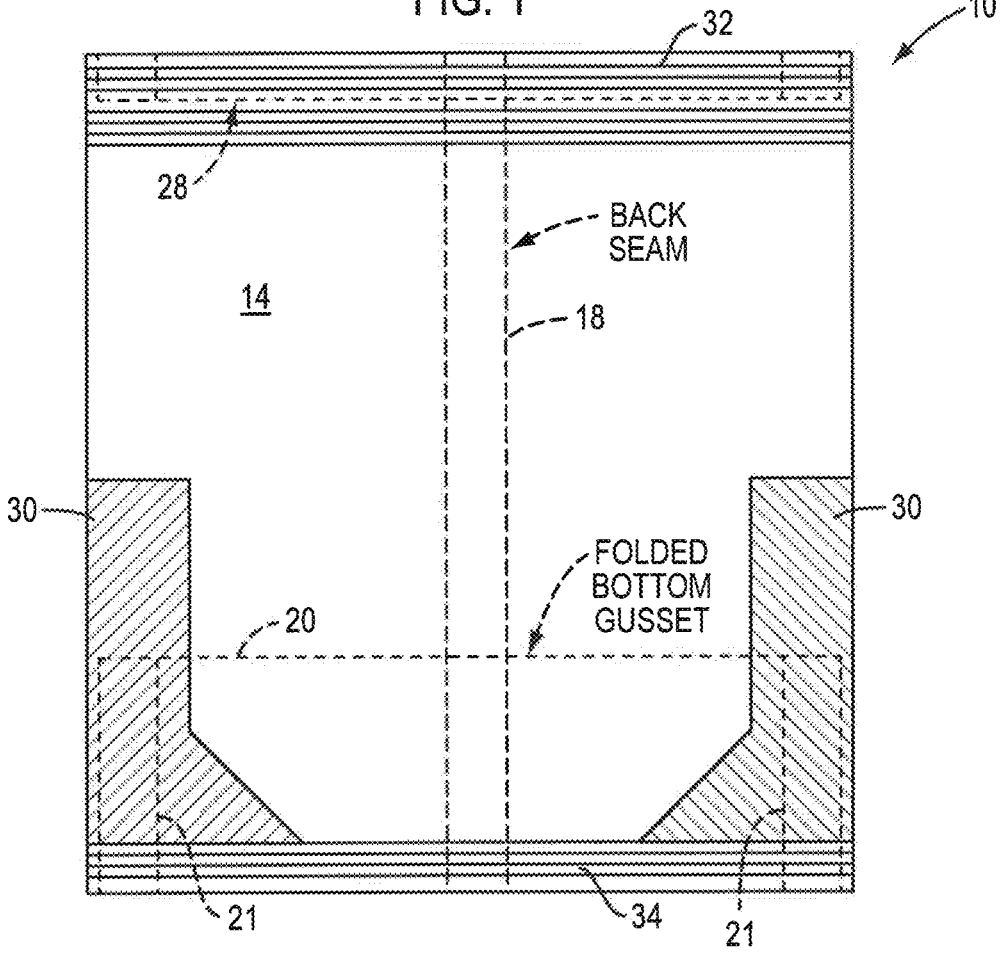
FIG. 1 is a diagrammatic, front elevational view of a bottom-gusseted package having a folded gusset embodying the principles of the present invention.

While the present invention is susceptible of embodiment in various forms, there is shown in the drawings and will hereinafter be described the presently preferred embodiments, with the understanding that the present disclosure should be considered as an exemplification of the invention, and is not intended to limit the invention to the specific embodiments illustrated.

U.S. Pat. Nos. 4,909,017, 4,617,683, 5,902,047, 6,971,794, and 8,182,407, and U.S. Patent Publications No. 2014/0294326, and No. 2014/0161373, illustrate various package constructions and formation methods, and are all hereby incorporated by reference.

The present invention is directed to a "stand-up" style of package, which includes a bottom gusset which can be opened or splayed apart to permit the package to assume a generally self-standing, upright configuration. This type of package facilitates convenient retail display and use by consumers.

Notably, and as will further described, a package embodying the present invention can be formed by positioning a gusset-forming sleeve transversely of a flexible web of material from which the package is formed. Formation in this fashion very desirably permits the package to be used in conjunction with widely-used form, fill and sealing machinery, thus permitting versatile and cost-effective use of the package. Packages can be substantially entirely formed in connection with package filling, but it is contemplated that rolls of packaging material can be formed which have gusset-forming sleeves "pre-applied" thereto for subsequent use with filling machinery.

With reference to FIGS. 1-7, a bottom-gusseted package 10 embodying the principles of the present invention comprises a package body formed from a flexible web 12 having a longitudinal axis. The flexible web 12 is folded to define a front package panel 14 and a rear package 16 of the package body. The front and rear package panels 14, 16 are joined to each other at respective lateral side margins of the package body, with the flexible web 12 being joined to itself along a longitudinal seam 18 which extends parallel to the longitudinal axis LA of the flexible web.

The package 10 formed in accordance with the present invention includes a bottom gusset 20, including folded ends 21, positioned between the front and rear package panels 14, 16, with the bottom gusset 20 extending upwardly and inwardly from the lower edges of the front and rear package panels. The bottom gusset 20 is positioned within the package body transversely of the longitudinal axis of the package body, and transversely of the longitudinal axis of the flexible web 12 from which the package body is formed. This permits a package body to be very efficiently formed at any selected height.

In this embodiment, efficient formation of the package 10 is facilitated by arranging the bottom gusset 20 within the package such that at least one end 21 of the gusset 20 is folded within the package body. This is achieved by folding at least one end of each individual sleeve which forms the bottom gusset of the package. Normal manufacturing tolerances and variations are readily accommodating while ensuring formation of a package 10 in which the contents are sealed, and the bottom gusset 20 opens as intended.

Figure 7:
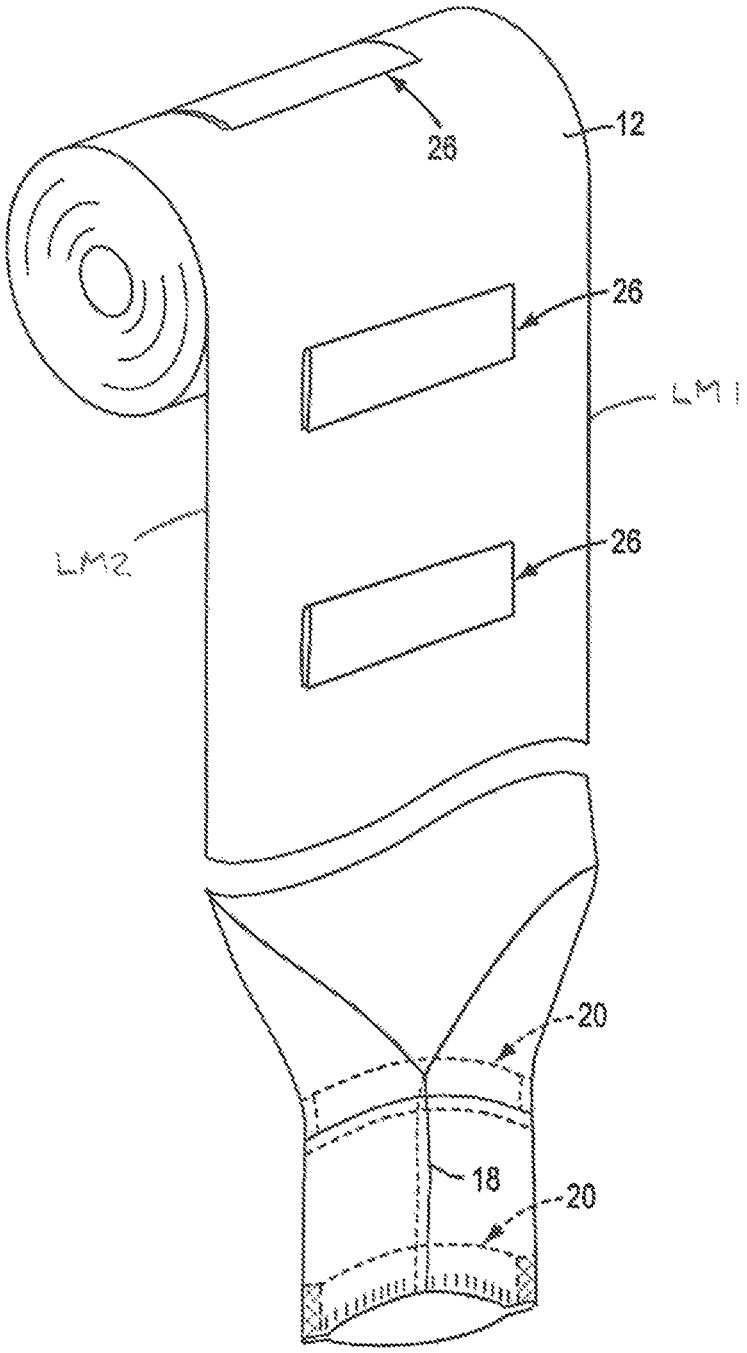
FIG. 7 is a diagrammatic view illustrating formation a method of forming a bottom-gusseted package in accordance with the present invention.
Figure 8:
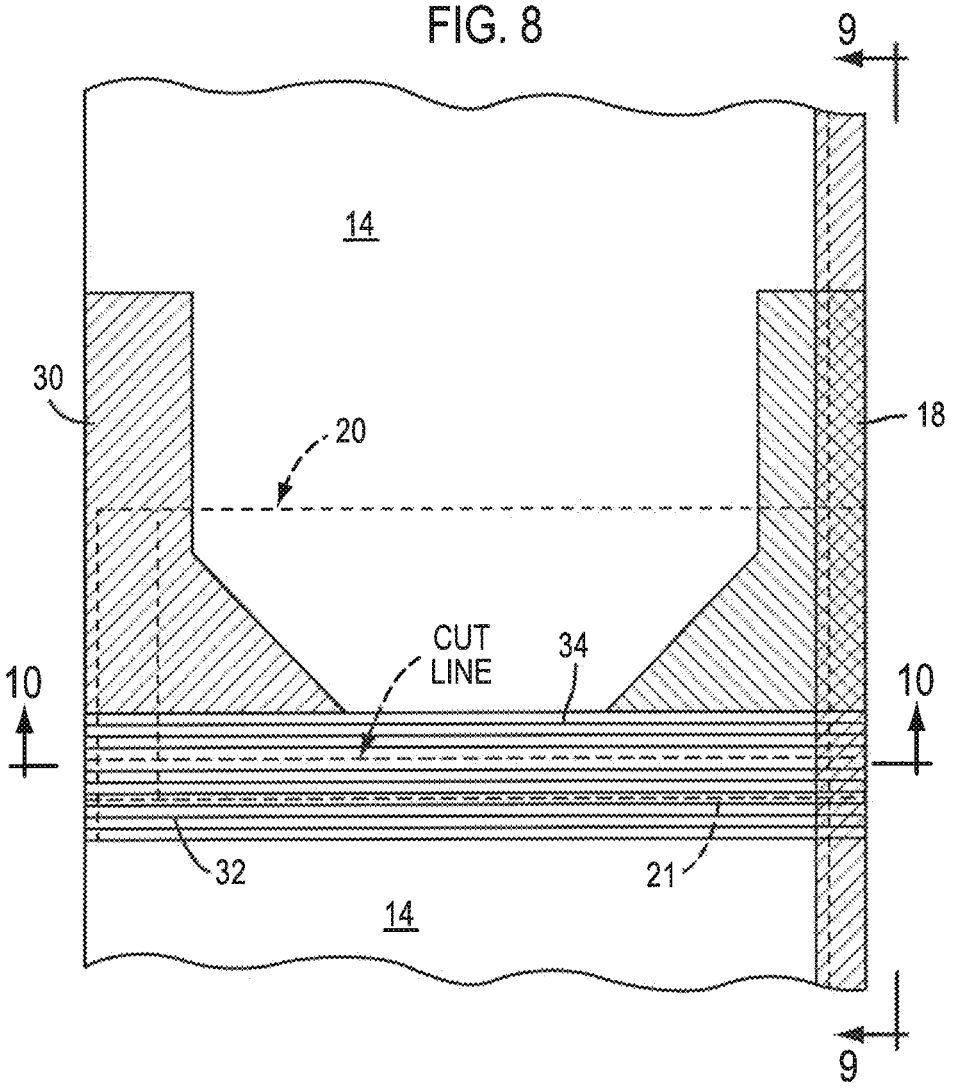
FIG. 8 is a partial, diagrammatic front elevational view illustrating formation of an alternative embodiment of a bottom-gusseted package having a bottom gusset folded at only one end thereof embodying the principles of the present invention.
Figure 9:
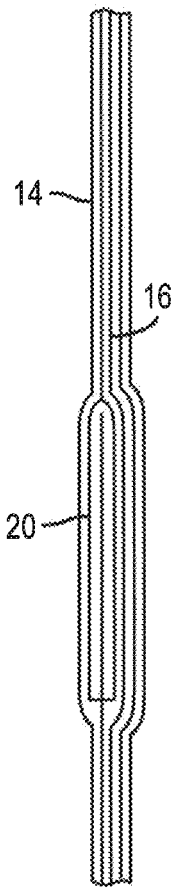
FIG. 9 is a partial, diagrammatic side elevational view take generally along lines 9-9 in FIG. 8.
Figure 10:
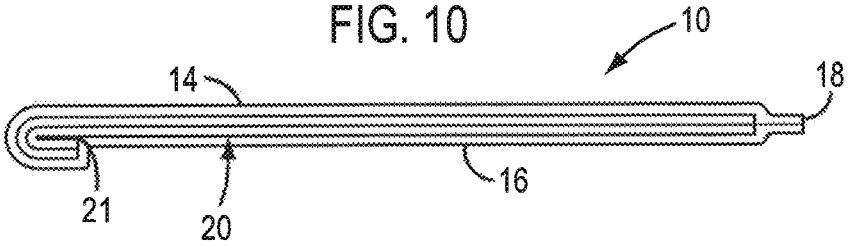
FIG. 10 is a diagrammatic cross-sectional view taken generally along lines 10-10 in FIG. 8.
Figure 11:
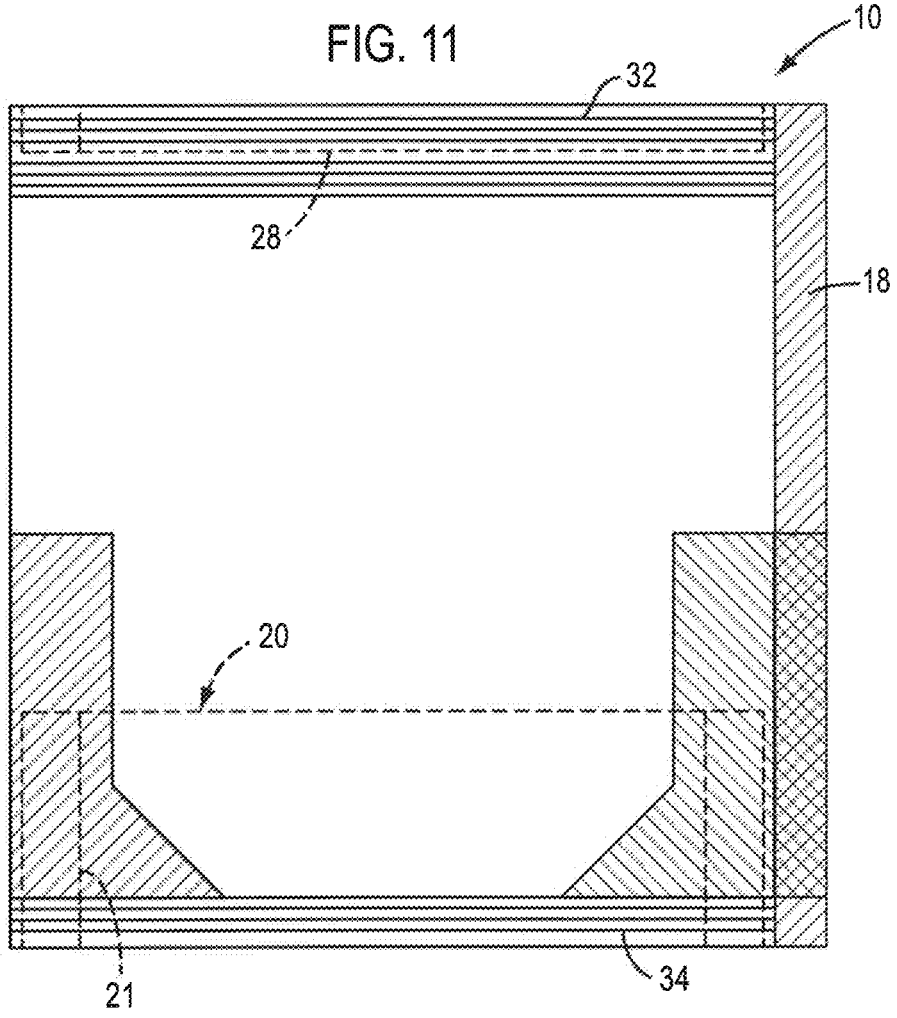
FIG. 11 is a diagrammatic front elevational view of this embodiment of the bottom-gusseted package having a bottom gusset folded at only one end thereof.
Figure 12:
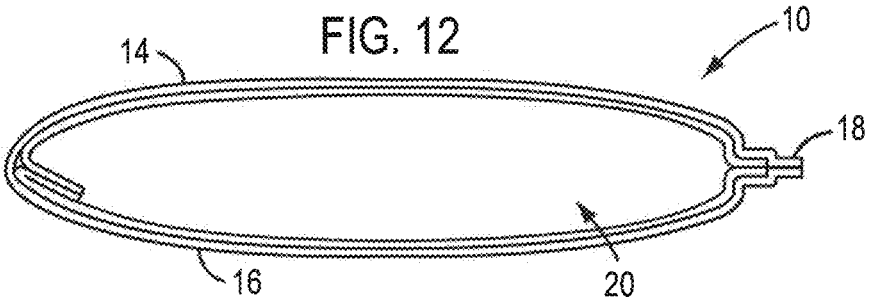
FIG. 12 is a diagrammatic bottom plan view of the package shown in FIG. 11 illustrating the bottom gusset in an opened condition.
Figure 13:
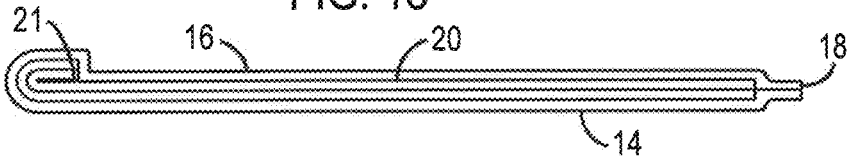
FIG. 13 is a diagrammatic top plan view of the package shown in FIG. 11.
Figure 14:
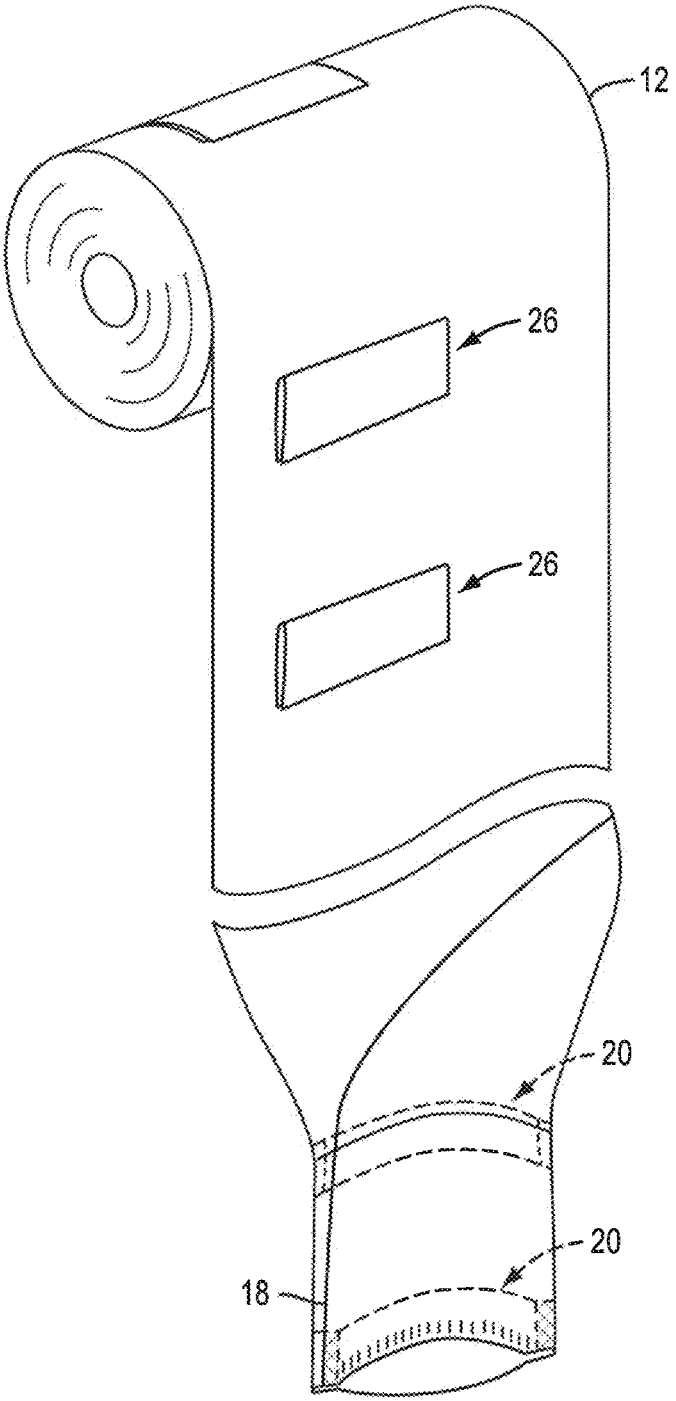
FIG. 14 is a diagrammatic view illustrating formation of the package shown in FIGS. 8-13, in accordance with the present invention.

FIG. 7 diagrammatically illustrates a method of making bottom-gusseted packages accordance with the present invention. The method includes providing the flexible web 12 of material having a longitudinal axis. Suitable polymeric material can be employed by virtue of its liquid-impermeable characteristics, and heat-sealing capabilities.

The present method further comprises providing a plurality of folded, individual sleeves 26, with each sleeve 26 eventually forming the bottom gusset 20 of the packages 10. The sleeves 26 can be cut from a folded web of sleeve-forming material. The individual sleeves 26 are joined to the flexible web 12 in spaced apart relationship longitudinally thereof. The spacing between the individual sleeves 26 corresponds to the length of each of the bottom-gusseted packages 10 being formed.

To permit heal-sealing formation of the present package, the exterior surface of each folded sleeve 26 is readily heat-sealable to the flexible web 12. In contrast, the inside surface of each of the folded, individual sleeves 26 is non-heat sealable to itself, thus facilitating formation of a bottom gusset 20 which spreads or opens to permit the packages 10 being formed to be generally self-standing. Thus, the interior surface of the folded sleeve 26 has heat-sealing characteristics that differ from the heat-sealing characteristics of the exterior surface. To this end, the sleeve-forming web from which sleeves 26 are formed can be made from a material which is different than the flexible web which forms the package body.

Package formation includes the folding flexible web of material 12, and joining the lateral margins LM1, LM2 thereof to form a folded flexible web. This effects formation of a package body for each of the bottom-gusseted packages 10, including a front package panel 14 and a rear package panel 16 joined at opposite side margins thereof.

Notably, in this embodiment, attendant to the folding step, at least one end of each individual sleeve 26 within the folded web is also folded. As will described, folding of the ends of each individual, gusset-forming sleeve 26 permits efficient placement of the individual sleeves on the flexible web 12, and facilitates heat-sealing the web 12 and sleeve 26 to close the interior of the package being formed. If desired, each of the individual sleeves 26 can be provided with a length which is greater than the width of the folded web of flexible material, such that the folding step includes folding each end of each of the individual sleeves. However, depending upon design considerations and normal manufacturing tolerances, only one end on each sleeve 26 can be folded, while the other end remains unfolded.

Attendant to package filling, such as on a form, fill and sealing apparatus, the folded, flexible web 12 is cut at intervals each corresponding in length to the length of each bottom-gusseted package 10. Each individual sleeve 26 provides a bottom gusset 20 for a respective one of the packages 10 being formed.

Attendant to cutting the folded web 12 into individual packages 10, the individual gusset-forming sleeve 26 can be cut substantially simultaneously, so that each individual sleeve provides: (1) the bottom gusset 20 for one of the packages being formed, and (2) a top sleeve portion 28 for an adjacent one of the packages 10 being formed. The top sleeve portion 28 can be configured to include a dispensing feature, an upper package seal, and/or a recloseable fastener feature. However, it is within the purview of the present invention that the invention be practiced for forming packages with a bottom gusset only, without a top sleeve portion.

The folding step can include folding the flexible web of material generally at the longitudinal axis thereof, with the individual sleeves 26 positioned to extend generally between the longitudinal axis and the joined lateral margins of the flexible web 12. By formation in this manner, each of the individual sleeves 26 is folded only at one end thereof. Formation in this fashion in shown in the embodiment illustrated in FIGS. 8-14. In this embodiment, the longitudinal seam 18 of the package is positioned at one side margin thereof.

The present method contemplates forming at least one side seal joining the front and rear package panels to the individual sleeve at respective ends thereof, including joining the front and rear package panels 14, 16 to each individual sleeve 26 at respective ends thereof, wherein the side seals 30 extend above and overlap the respective individual sleeve and join the front and rear package panels to each other.

In both of the embodiments illustrated in FIGS. 1-11, side seals 30 are provided at the opposite ends of each bottom gusset 20, with the side seals configured to join the front and rear package panel 14, 16 to each other above the respective bottom gusset. Depending upon the specific positioning of each bottom gusset 20 within the package, which may vary due to normal manufacturing tolerances, one or both of the side seals 30 of each package can join the front and rear package panels to each other laterally adjacent to the bottom gusset.

Figure 2:
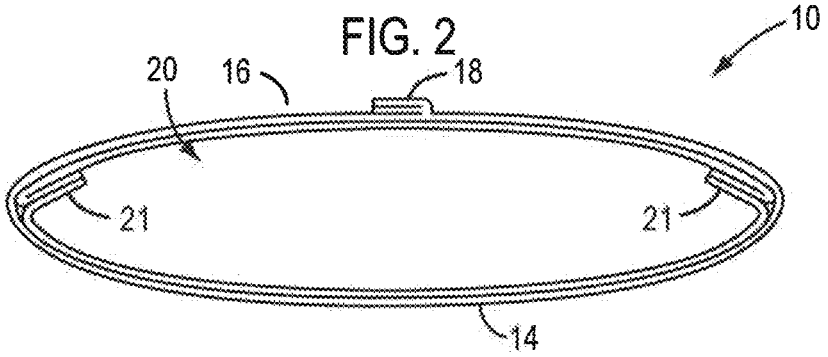
FIG. 2 is a diagrammatic bottom plan view of the package shown in FIG. 1 illustrating the bottom gusset in an opened condition.
Figure 3:
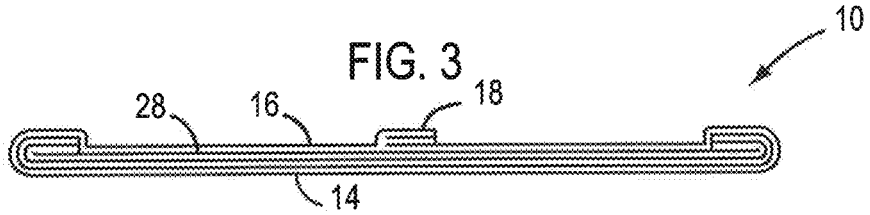
FIG. 3 is a diagrammatic top plan view of the package shown in FIG. 1.
Figure 4:
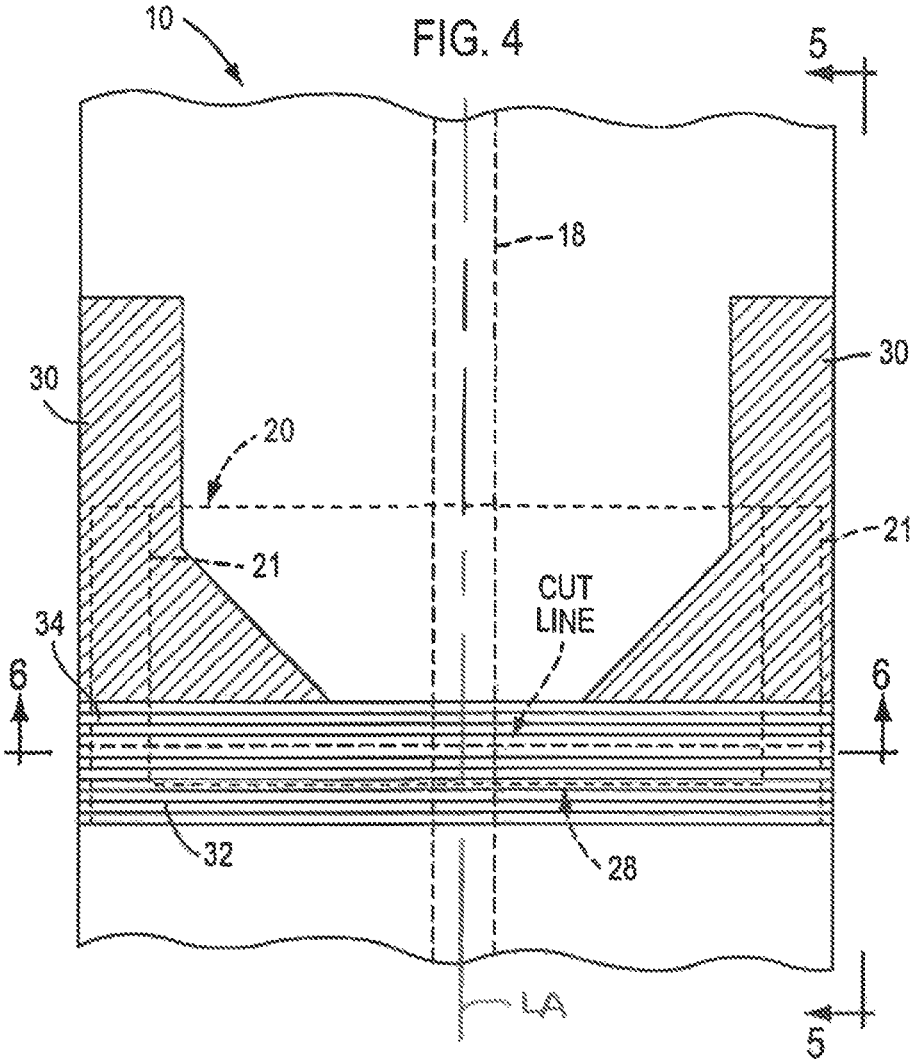
FIG. 4 is a partial, diagrammatic front elevational view showing formation of a bottom-gusseted package having a folded gusset embodying the principles of the present invention.
Figure 5:
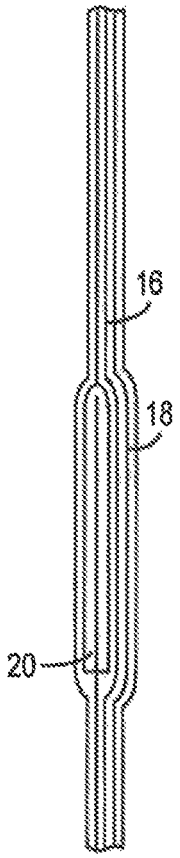
FIG. 5 is a partial, diagrammatic side elevational view taken generally along lines 5-5 in FIG. 4.
Figure 6:
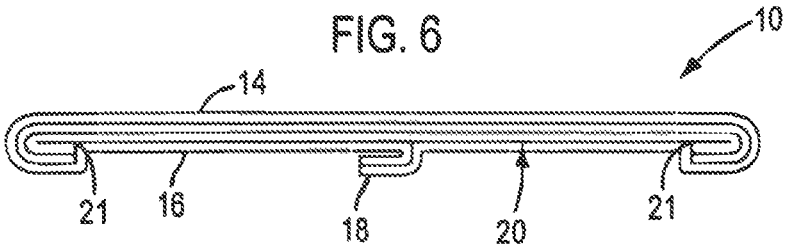
FIG. 6 is a diagrammatic, cross-sectional view taken generally along lines 6-6 in FIG. 4.

Another aspect of the present invention contemplates that the step of joining the lateral margins of the flexible web 12 to form the longitudinal seal 18 of the package as a fin seal, best shown in FIGS. 2, 3 and 6, comprising two plies of the flexible web material. The fin seal can be folded against the rear package panel 16, so a thickness of package at the fin seal is substantially equal to a thickness of each package at the folded ends of the individual sleeve providing the bottom gusset 20 of the package. As will be evident from FIG. 3, heat-sealing formation is desirably facilitated.

Attendant to package formation and filling, end seals 32, 34 can be formed respectively closing and sealing the top and bottom of each package 10. When the package 10 is formed with a top sleeve portion 28, the end seal 32 at the top of the package can be formed to substantially surround the bottom and sides of the top sleeve portion 28. Since the inner surfaces of the top sleeve portion are not heat-sealable, access to the contents of the package can be effected by splitting and separating the two layers of sleeve material which form the top sleeve portion.

Figure 15:
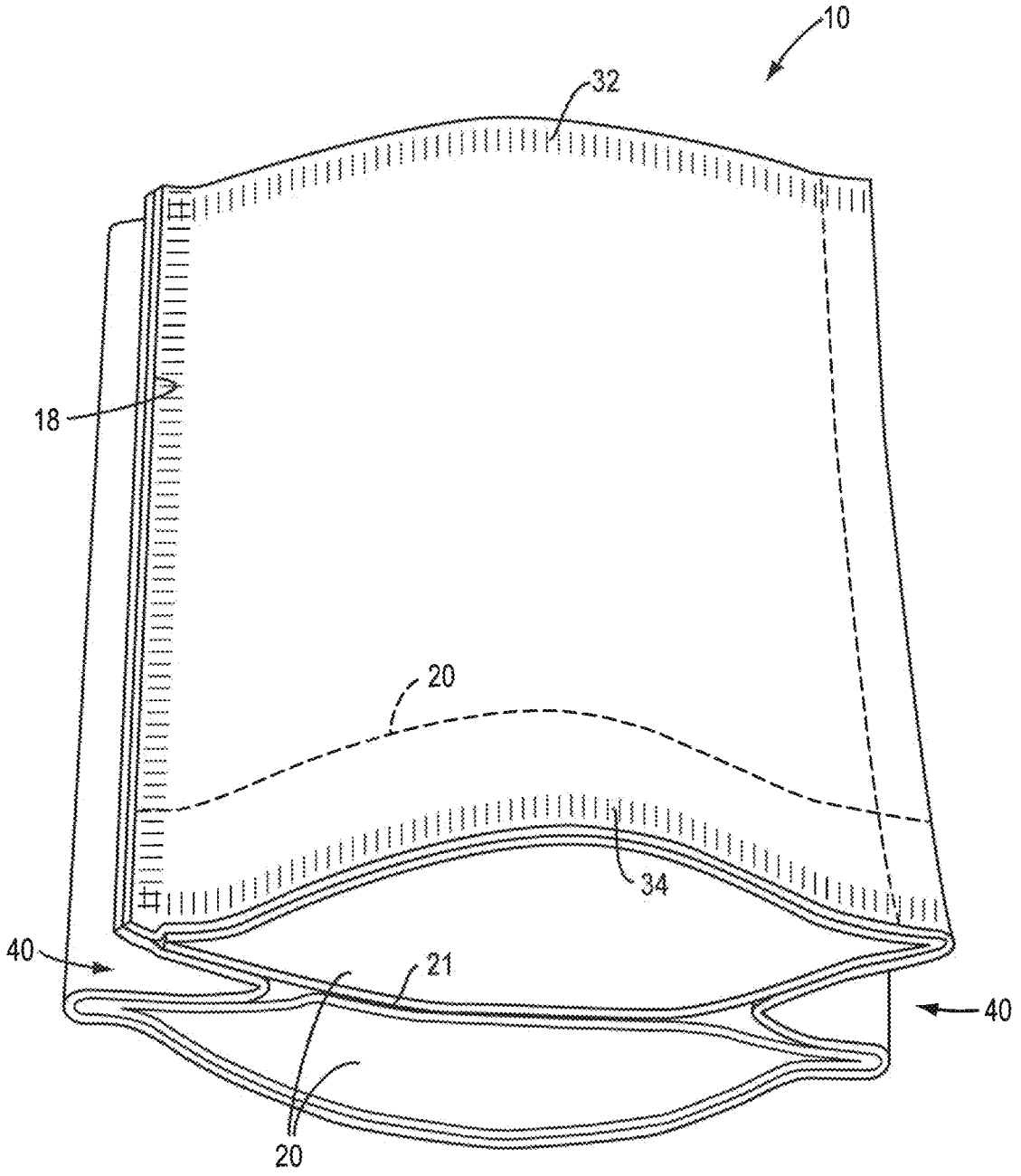
FIG. 15 is a diagrammatic perspective view illustrating a further embodiment of the present bottom-gusseted package, including a bottom gusset which is folded to form a pair of bottom gussets, with the package including a pair of inwardly extending side gussets.
Figure 16:
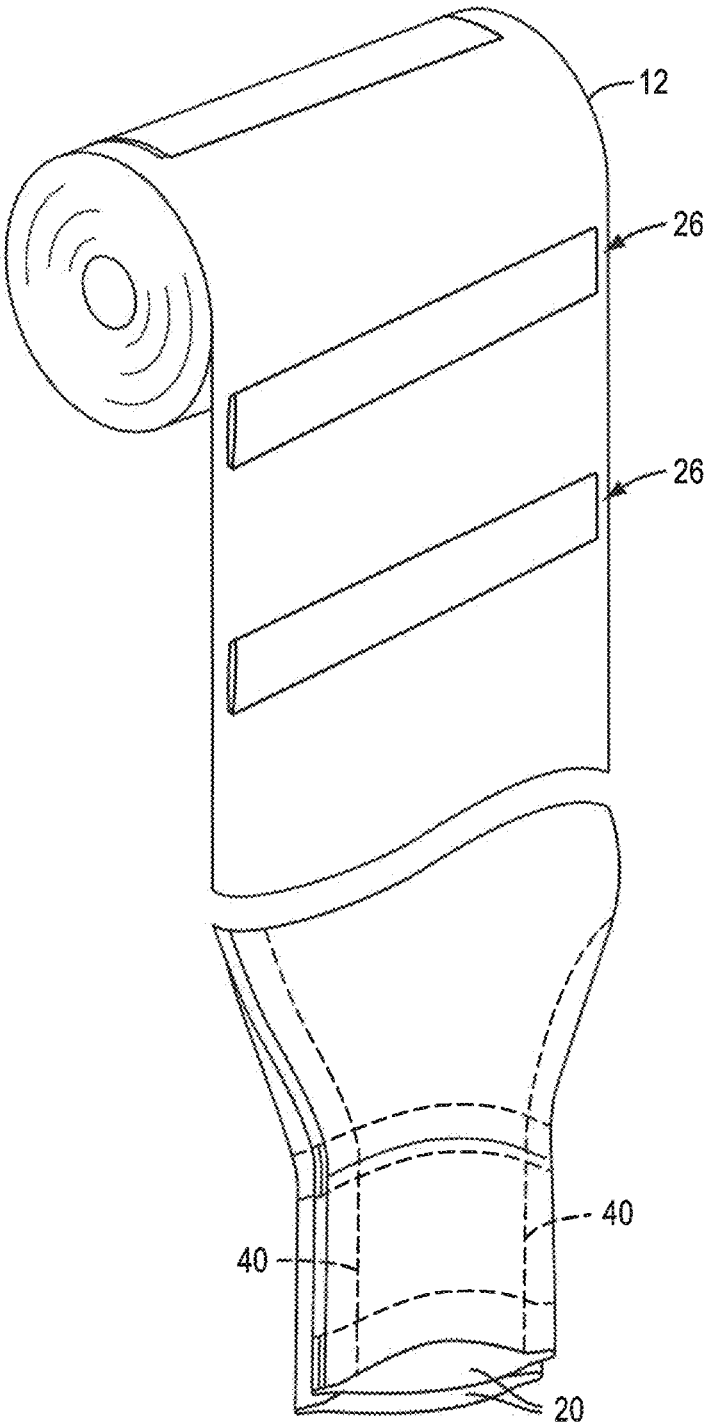
FIG. 16 is a diagrammatic view illustrating formation of the package illustrated in FIG. 15.

With reference now to FIGS. 15 and 16, in another embodiment of the invention, the flexible web of material 12 can be formed to include a pair of inwardly extending side gussets 40. In this embodiment, the folding step includes folding each of the individual sleeves 26 to extend adjacent to itself within the folded flexible web 12 to thereby form each of the packages 10 with a pair of bottom gussets 20, 20 adjacent to each other. The method includes joining inner edge portions of bottom gussets to each other at 21 to close the interior of the package.

A method of making bottom-gusseted packages in accordance with this aspect of the present includes forming the pair of inwardly extending side gussets 40 at respective opposite edges of said front and rear package panels 14, 16, with the pair of side gussets each extending between the pair of bottom gussets 20, 20. In this embodiment, the lateral margins of the flexible web are joined at seam 18 at one of the side gussets 30 to join an edge of one of the front and rear package panels 14, 16 to the side gusset.

As noted, it is presently contemplated that the folded sleeve-forming web from which the bottom gussets are formed has an inside surface of which does not heat-seal to itself. Since package formation, and advancement through the form, fill and seal machine can sometimes orient the bottom gusset in the "leading" direction, in can be desirable to close the individual sleeves against opening during such advancement. This can be achieved by closing each of the individual sleeves prior to joining the individual sleeves to the flexible web of material From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making bottom-gusseted packages, comprising the steps of:

providing a flexible web of material having a longitudinal axis, providing a plurality of individual sleeves each having spaced ends and folded in a first manner;

joining said individual sleeves to said flexible web in spaced apart relationship longitudinally of said flexible web, with the spacing between said individual sleeves corresponding to the length of each of said bottom-gusseted packages being formed;

folding said flexible web of material and joining the lateral margins thereof to form a folded flexible web, and to thereby form a package body for each of said bottom-gusseted packages, each package body including a front package panel and a rear package panel joined at opposite side margins thereof, said individual sleeves being positioned generally within said folded flexible web, wherein said folding step includes folding each of said individual sleeves in a second manner different than the first manner; and cutting said folded flexible web at intervals each corresponding in length to said length of each of said bottom-gusseted packages, said folding step including folding each said individual sleeve to cause one of the spaced ends of each said individual sleeve to be moved laterally towards, and into adjacent relationship with, the other of the spaced ends of each said individual sleeve, whereby each said individual sleeve is caused to extend adjacent to itself within said folded flexible web to thereby form each of said packages with a pair of bottom gussets adjacent to each other.

2. A method of making bottom-gusseted packages in accordance with claim 1, wherein said cutting step includes cutting each said individual sleeve to form: (1) said pair of bottom gussets for one of the packages being formed, and (2) a top sleeve portion for an adjacent one of the packages.

3. A method of making bottom-gusseted packages in accordance with claim 1, said method including joining inner edge portions of bottom gussets to each other.

4. A method of making bottom-gusseted packages in accordance with claim 3, including forming a pair of inwardly extending side gussets in said folded flexible web at respective opposite edges of said front and rear package panels, each of said inwardly extending side gussets extending between said pair of bottom gussets.

5. A method of making bottom-gusseted packages comprising the steps of:

providing a flexible web of material having a longitudinal axis, providing a plurality of individual sleeves each folded in a first manner;

joining said individual sleeves to said flexible web in spaced apart relationship longitudinally of said flexible web, with the spacing between said individual sleeves corresponding to the length of each of said bottom-gusseted packages being formed;

folding said flexible web of material and joining the lateral margins thereof to form a folded flexible web, and to thereby form a package body for each of said bottom-gusseted packages, each package body including a front package panel and a rear package panel joined at opposite side margins thereof, said individual sleeves being positioned generally within said folded flexible web, wherein said folding step includes folding each of said individual sleeves in a second manner different than the first manner; and cutting said folded flexible web at intervals each corresponding in length to said length of each of said bottom-gusseted packages, so each individual sleeve provides a bottom gusset for a respective one of the packages being formed, wherein said folding step includes folding said flexible web of material generally at said longitudinal axis thereof, so that each of said individual sleeves extends generally between said longitudinal axis and the joined side margins of said flexible web of material, and wherein the individual sleeves have spaced ends and each of said individual sleeves is folded in the second manner only at one of the respective ends thereof.

6. A method of making bottom-gusseted packages comprising the steps of:

providing a flexible web of material having a longitudinal axis, providing a plurality of individual sleeves each folded in a first manner;

joining said individual sleeves to said flexible web in spaced apart relationship longitudinally of said flexible web, with the spacing between said individual sleeves corresponding to the length of each of said bottom-gusseted packages being formed;

folding said flexible web of material and joining the lateral margins thereof to form a folded flexible web, and to thereby form a package body for each of said bottom-gusseted packages, each package body including a front package panel and a rear package panel joined at opposite side margins thereof, said individual sleeves being positioned generally within said folded flexible web, wherein said folding step includes folding each of said individual sleeves in a second manner different than the first manner;

cutting said folded flexible web at intervals each corresponding in length to said length of each of said bottom-gusseted packages, so each individual sleeve provides a bottom gusset for a respective one of the packages being formed; and forming at least one side seal joining said front and rear package panels to said individual sleeve at a respective folded portion thereof, including joining said front and rear package panels to each other above said bottom gusset.

7. A method of making bottom-gusseted packages comprising the steps of:

providing a flexible web of material having a longitudinal axis, providing a plurality of folded, individual sleeves;

joining said individual sleeves to said flexible web in spaced apart relationship longitudinally of said flexible web, with the spacing between said individual sleeves corresponding to the length of each of said bottom-gusseted packages being formed;

folding said flexible web of material and joining the lateral margins thereof to form a folded flexible web, and to thereby form a package body for each of said bottom-gusseted packages, each package body including a front package panel and a rear package panel joined at opposite side margins thereof, said individual sleeves being positioned generally within said folded flexible web, wherein said folding step includes folding each of said individual sleeves; and cutting said folded flexible web at intervals each corresponding in length to said length of each of said bottom-gusseted packages, wherein each of said individual sleeves has a length between spaced ends which is greater than the width of the folded web of flexible material, said folding step including folding each of said individual sleeves to cause one of the spaced ends of each said individual sleeve to be moved laterally towards, and into adjacent relationship with, the other of the spaced ends of each said individual sleeve, whereby each said individual sleeve is caused to extend adjacent to itself within said folded flexible web to thereby form each of said packages with a pair of bottom gussets adjacent to each other.

8. A method of making bottom-gusseted packages in accordance with claim 7, wherein said step of joining the lateral margins of said flexible web of material includes forming a fin seal comprising two plies of said flexible web of material, said fin seal being folded against said rear package panel, so a thickness of each said package at said fin seal is substantially equal to a thickness of each said package at the one folded end of each said individual sleeve providing the pair of bottom gussets of the package.

9. A method of making bottom-gusseted packages comprising the steps of:

providing a flexible web of material having a longitudinal axis, providing a plurality of individual sleeves each folded in a first manner;

joining said individual sleeves to said flexible web in spaced apart relationship longitudinally of said flexible web, with the spacing between said individual sleeves corresponding to the length of each of said bottom-gusseted packages being formed;

folding said flexible web of material and joining the lateral margins thereof to form a folded flexible web, and to thereby form a package body for each of said bottom-gusseted packages, each package body including a front package panel and a rear package panel joined at opposite side margins thereof, said individual sleeves being positioned generally within said folded flexible web, wherein said folding step includes folding each of said individual sleeves in a second manner different than the first manner;

cutting said folded flexible web at intervals each corresponding in length to said length of each of said bottom-gusseted packages, so each individual sleeve provides a bottom gusset for a respective one of the packages being formed, wherein each of said individual sleeves has a length between spaced ends which is greater than the width of the folded web of flexible material, said folding step including folding at least one of the ends of each of said individual sleeves; and forming a pair of side seals joining said front and rear package panels to each individual sleeve at respective folded ends thereof, wherein said side seals extend above and overlap the respective individual sleeve and join said front and rear package panels to each other.

* * * * *